US007532843B2

(12) United States Patent
Kern et al.

(10) Patent No.: US 7,532,843 B2
(45) Date of Patent: May 12, 2009

(54) IMAGE FORMING SUBSTANCE ENGAGING DEVICE

(75) Inventors: Royden Thomas Kern, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/204,610

(22) Filed: Aug. 16, 2005

(65) Prior Publication Data

US 2007/0041749 A1 Feb. 22, 2007

(51) Int. Cl.
*G03G 15/08* (2006.01)

(52) U.S. Cl. ..... 399/254; 399/256; 399/263

(58) Field of Classification Search ..... 399/263, 399/256, 254

See application file for complete search history.

(56) References Cited

U.S. PATENT DOCUMENTS

| | | | | |
|---|---|---|---|---|
| 4,456,364 | A * | 6/1984 | Hatzis | 399/263 |
| 4,931,838 | A | 6/1990 | Ban et al. | |
| 5,202,732 | A * | 4/1993 | Yahata | 399/263 |
| 5,655,195 | A * | 8/1997 | Ichikawa et al. | 399/263 |
| 5,666,618 | A | 9/1997 | Lee et al. | |
| 5,686,985 | A | 11/1997 | Hayashi | |
| 5,822,664 | A | 10/1998 | Oka et al. | |
| 5,956,551 | A | 9/1999 | Ahn | |
| 6,026,263 | A * | 2/2000 | Nakahata et al. | 399/263 |
| 6,055,401 | A | 4/2000 | Tonomoto et al. | |
| 6,131,008 | A * | 10/2000 | Kanamori et al. | 399/263 |
| 6,246,854 | B1 | 6/2001 | Kurosawa et al. | |
| 6,405,010 | B2 * | 6/2002 | Ashikari et al. | 399/262 |
| 6,415,126 | B2 * | 7/2002 | Kaneshige et al. | 399/256 |
| 6,418,290 | B1 * | 7/2002 | Isomura et al. | 399/254 |
| 6,456,810 | B1 | 9/2002 | Deguchi et al. | |
| 6,459,876 | B1 | 10/2002 | Buchanan et al. | |
| 6,501,933 | B2 | 12/2002 | Ishii | |
| 6,510,291 | B2 | 1/2003 | Campbell et al. | |
| 6,510,300 | B2 | 1/2003 | Mizoguchi et al. | |
| 6,628,910 | B2 | 9/2003 | Tanisawa et al. | |
| 6,771,922 | B2 | 8/2004 | Blanck et al. | |
| 2004/0126143 | A1 * | 7/2004 | Blanck et al. | 399/260 |

* cited by examiner

*Primary Examiner*—David M Gray
*Assistant Examiner*—Bryan P Ready
(74) *Attorney, Agent, or Firm*—Steven J. Grossman

(57) ABSTRACT

The present invention relates to engagement or transfer of an image forming substance within a reservoir of an image forming apparatus. This may be achieved by a device such as a paddle that may include an additional component for engagement or transfer of the image forming substance. The component may be, for example, wire material. The component may also include a body section and an axially aligned projection.

7 Claims, 5 Drawing Sheets

IMAGE FORMING SUBSTANCE ENGAGING DEVICE

FIELD OF INVENTION

The present invention relates to engagement or transfer of an image forming substance within a reservoir of an image forming apparatus. The image forming apparatus may include an electrophotographic device, ink printer, copier, fax, all-in-one device or multi-functional device.

BACKGROUND

In some image forming substance cartridges, an image forming substance sump or reservoir may be used to retain the image forming substance until the image forming substance may be required by the developer system. Inside of the image forming substance sump may be an agitating device, such as a paddle, to agitate and aid in the removal of image forming substance from the sump. In some cases, however, the agitating device may not be capable of reaching a substantial portion of the interior surface of the sump, which may be due, for example, to the geometry of the cartridge or due to poor image forming substance flow properties.

SUMMARY

An exemplary embodiment of the present invention relates to an apparatus and method for engaging image forming material in a reservoir in an image forming apparatus. The reservoir may include a paddle for engaging the image forming material or the interior surfaces of the reservoir. The paddle may include an axially elongated section capable of rotating in the reservoir. The paddle may also include another component which may similarly engage with the image forming material or with an interior surface in the reservoir. The reservoir may assume any shape.

BRIEF DESCRIPTION OF DRAWINGS

Features and advantages of the present invention are set forth herein by description of embodiments consistent with the present invention, which description should be considered in conjunction with the accompanying drawings, wherein.

DETAILED DESCRIPTION

The present invention relates to engagement or transfer of an image forming substance within a reservoir of an image forming apparatus. This may comprise a device such as a paddle that may aid in the removal of an image forming substance such as toner, ink or other developing agents from a sump within a cartridge. The paddle may include a component which engages the image forming substance in the cartridge. The cartridge may be utilized in an image forming apparatus which may include an electrophotographic device, ink printer, copier, fax, all-in-one device or multi-functional device.

Figure 1:
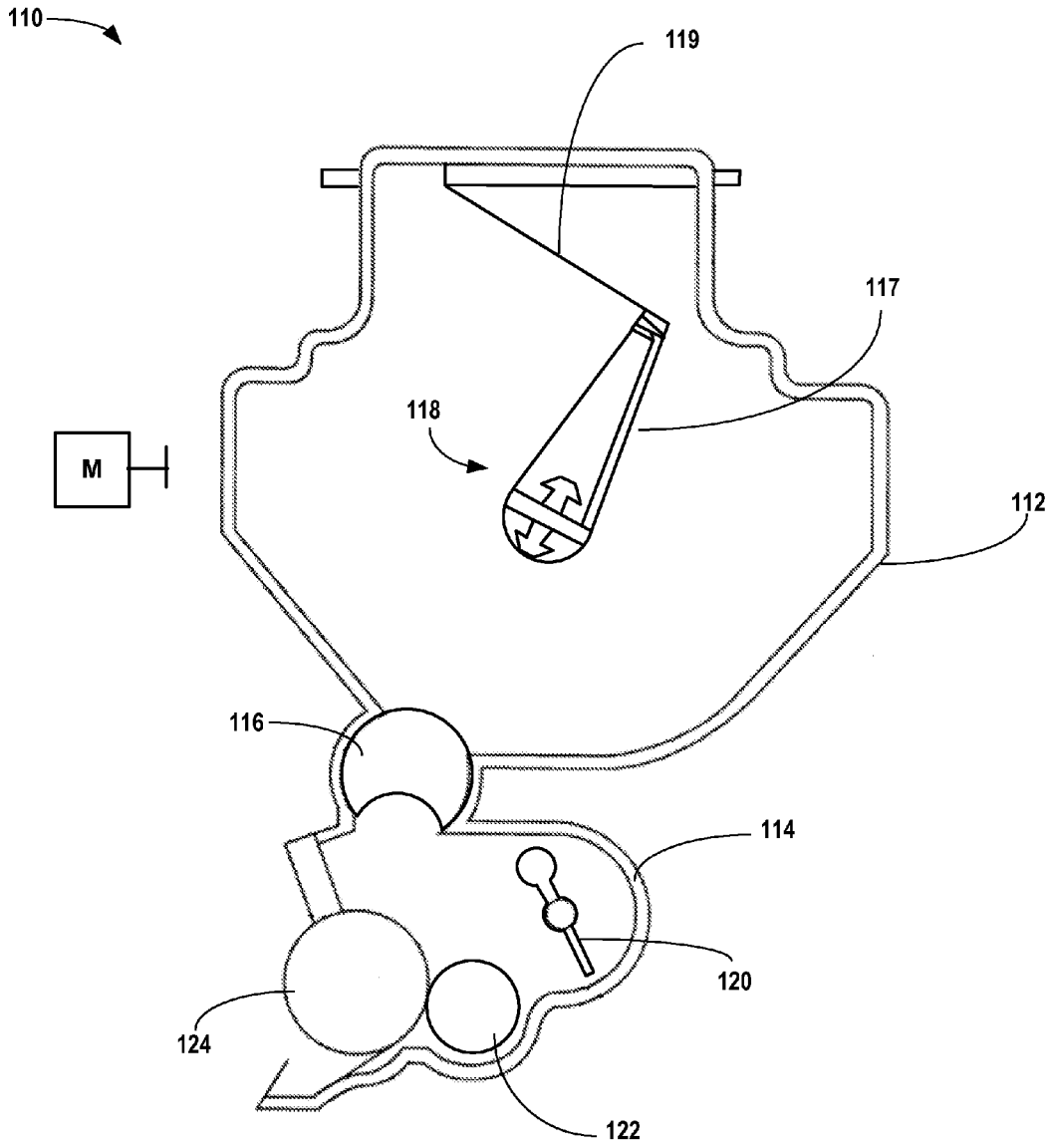
FIG. 1 is a side view of an exemplary embodiment of an image forming substance cartridge.

Illustrated in FIG. 1 is an exemplary cartridge 110 which may include a first sump 112 and a second sump 114. Image forming substance may be initially stored in the first sump 112 until the development process requires it. When required, the image forming substance may be metered into the second sump with the metering rotor 116.

A paddle 118 in the first sump 112 may be used to move the image forming substance to the metering rotor 116. In some cases the first sump 112 geometry may be dictated by other components in or surrounding the supply cartridge. For example, the first sump 112 may be arranged above the second sump or the interior surface of the first sump may include an irregular geometry. Accordingly, the paddle 118 may not be able to reach the entire interior surface of the first sump 112, in the radial and/or axial dimensions. When the image forming substance has relatively poor flow properties, the paddle 118 may not be able to remove substantially all of the image forming substance from the first sump 112.

Accordingly, in one exemplary and non-limiting embodiment, the present invention is directed to a device and method for engaging image forming substance in a cartridge. Referring to FIG. 1, the paddle 118 may have an axially elongated section 117 and a component 119 that may move the image forming substance from areas not accessible by the paddle 118 into areas reached by the paddle 118. The paddle 118 may then remove the image forming substance from the first sump 112. In a cartridge that is full, the component 119 may follow the path of the paddle, minimizing additional torque on the paddle motor M.

Figure 2:
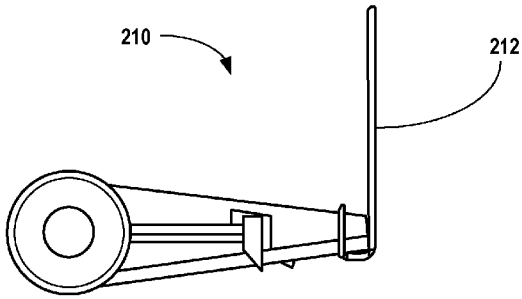
FIG. 2 is a side view of an exemplary embodiment of a paddle including a component.
Figure 3:
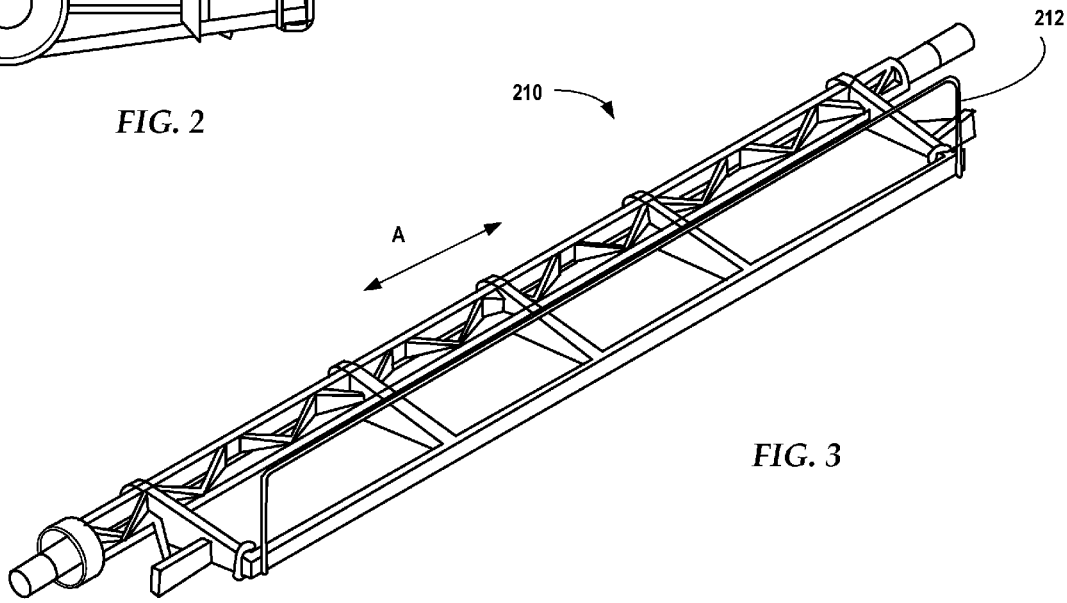
FIG. 3 is a perspective view of an exemplary embodiment of a paddle including a component.

FIGS. 2 and 3 illustrate an exemplary embodiment of a paddle 210 that includes a component 212. The component 212 may be used to physically move the image forming substance in the cartridge and remove the image forming substance from the first sump 112, illustrated in FIG. 1. The component 212 may be composed of wire and formed to wrap onto the paddle 210. The wire may be metal wire, such as steel. The device 212 may extend the reach of the paddle 210 in the axial and/or radial dimensions in the supply cartridge 110, illustrated in FIG. 1. In addition, it can be seen that the paddle 210 may be axially elongated in direction "A".

Figure 4:
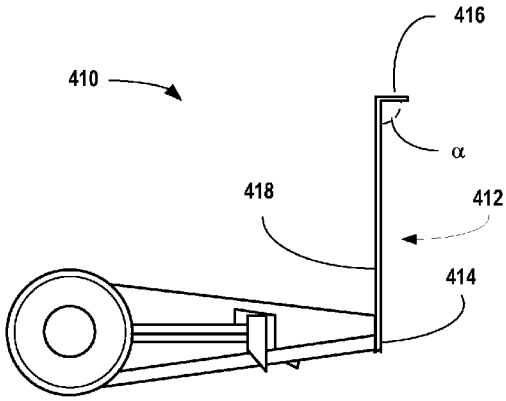
FIG. 4 is a side view of an exemplary embodiment of a paddle including a component.
Figure 5:
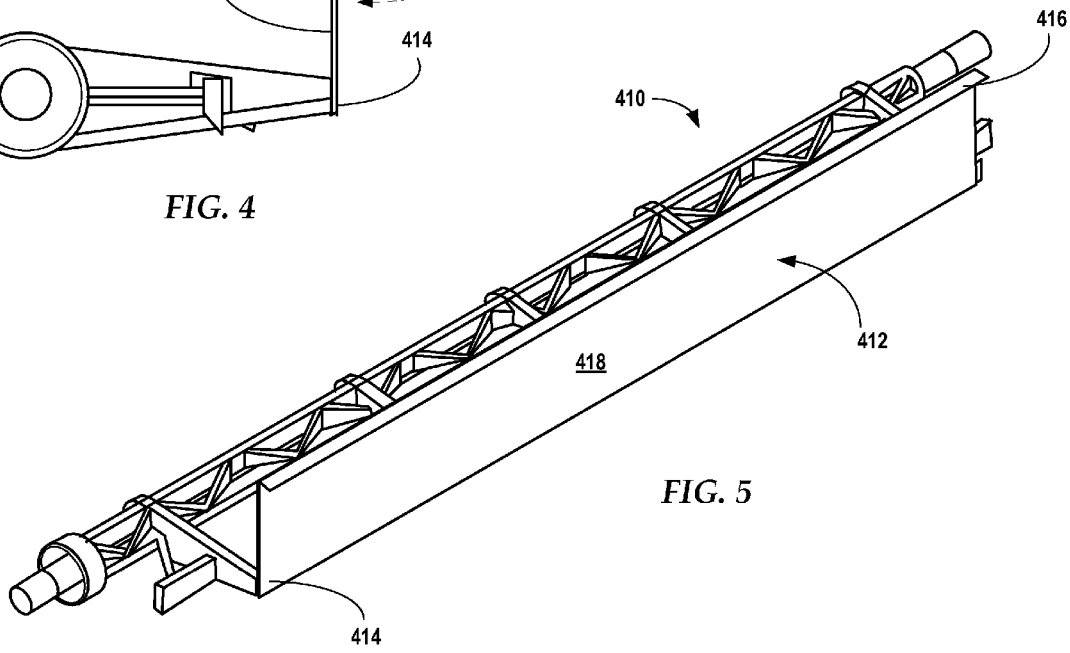
FIG. 5 is a perspective view of an exemplary embodiment of a paddle including a component.

The component may also be composed of a compliant polymer material, as illustrated in FIGS. 4 and 5. For example, the component 412 may be composed of polyester (e.g. Mylar®), polyetherimide (e.g. ULTEM®) or polycarbonate film. The component 412 may be attached to the end face 414 of the paddle device 410. The component may also include a body section 418 and a formed edge 416. The formed edge 416 may be angled from the body section 418 at an angle $\alpha$ anywhere between greater than 0 and less than 180 degrees, and any increment therebetween including 45 degrees, 90 degrees, 135 degrees, etc.

Figure 6:
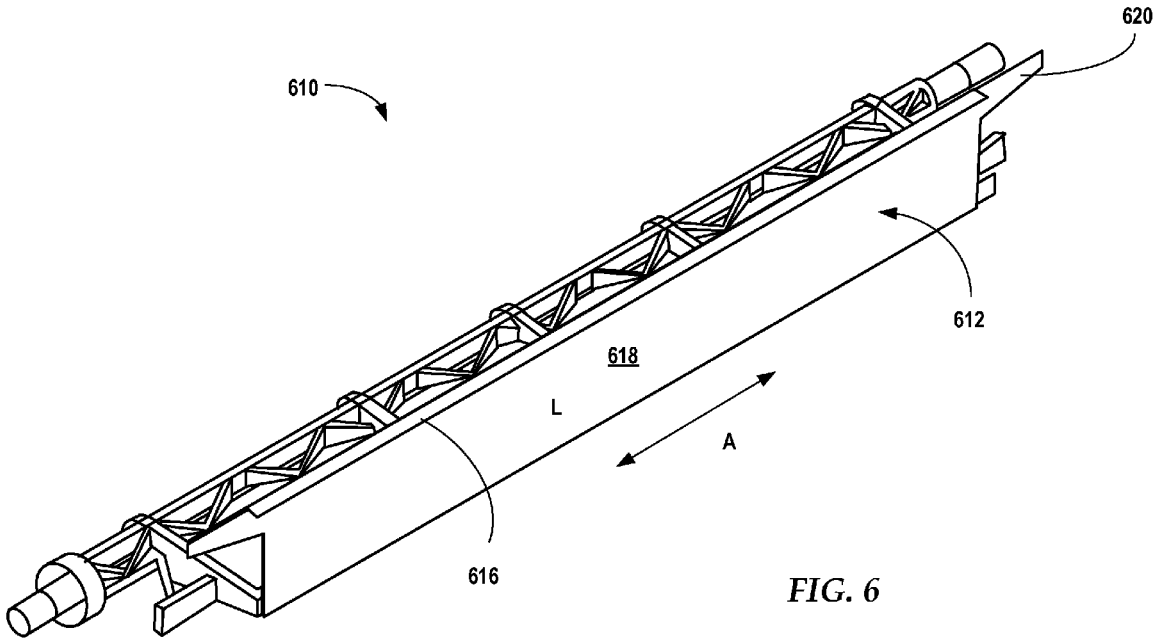
FIG. 6 is a perspective view of an exemplary embodiment of a paddle including a component.
Figure 7:
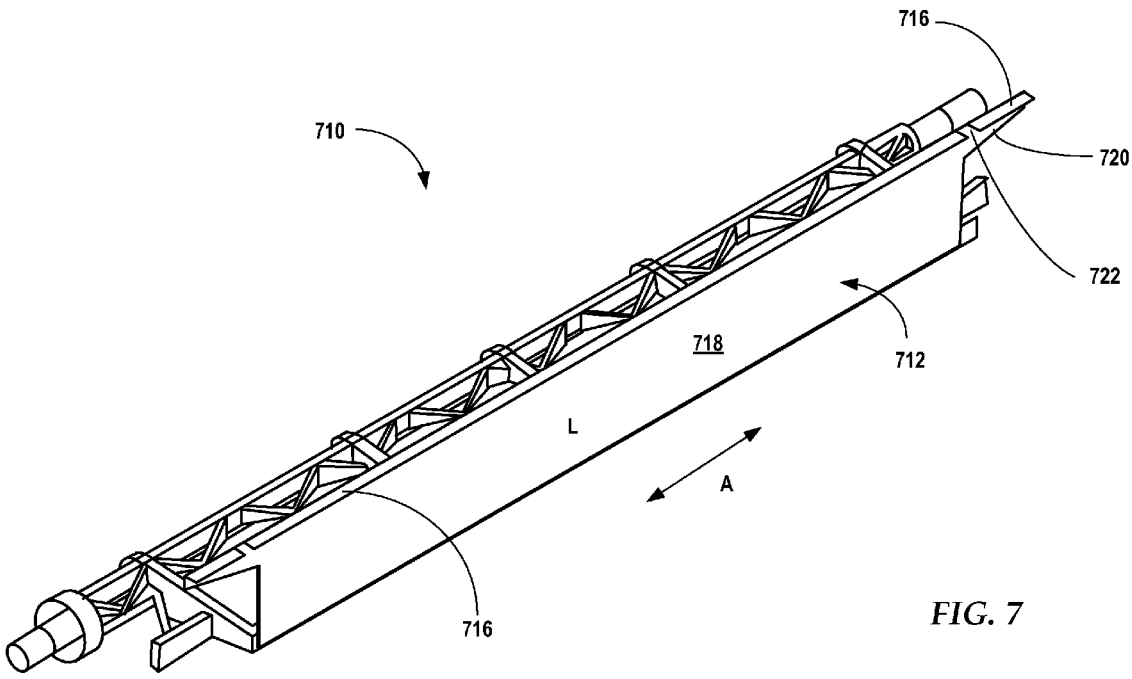
FIG. 7 is a perspective view of an exemplary embodiment of a paddle including a component.

The component may also have features extending in the axial direction "A" from the component, as illustrated in FIG. 6. For example, in one exemplary embodiment, the component 612 may include physical features, such as axially aligned projections 620. The projection may include any geometry, for example wings, tabs, flaps or other types of projections. The projections 620 extend from the component body section 618 of the component 612. Furthermore, the projections 620 may extend axially to reach corresponding surfaces in the reservoir. In FIG. 6, the formed edge 616 may extend along the body section 618. However, it should be appreciated that the formed edge 616 may extend to the projections 620. For example, in FIG. 7, the formed edge 716 extends in the axial direction A along the physical features or projections 720 as well as along the body section 718 of the component 712. It should also be appreciated that the formed edge 716 may also include notches 722 in the formed edge 716 of the component 712.

It can therefore be appreciated that the paddle described herein may extend the ability of the paddle to extend its reach into the reservoir. The paddle may therefore more effectively engage with image forming substance in both a radial and axial direction within the reservoir. The foregoing description is provided to illustrate and explain the present invention. However, the description hereinabove should not be considered to limit the scope of the invention set forth in the claims appended here to.

What is claimed is:

1. A paddle for engaging image forming material in a reservoir having an interior surface of irregular geometry, said paddle comprising an axially elongated section radially extending in a single direction from an axis of rotation of said paddle, capable of rotating in said reservoir and having an end face including a component for reaching said interior surface of irregular geometry, said component having a compliant polymeric body section having no openings therein attached to said end face and defined completely in a single first plane that is perpendicular to said axially elongated section having a front opposite said end face, a side and an axially aligned projection extending from said body section and not adjacent any other portion of said body and a formed edge reaching said surface of irregular geometry during rotation of said paddle for removing said image forming material from said surface not reached by said elongated section of said paddle, said formed edge defined completely in a single second plane directly adjoining said first plane, wherein said axially aligned projection and said formed edge are located along said side of the body section and said second plane defined by said formed edge is angled at an angle $\alpha$ between greater than 0 and less than 180 degrees from said front of said body section, wherein said front of said body section is positioned nearest said reservoir surface, wherein said axially aligned projection extends to reach a corresponding surface in said reservoir, in both axial and radial directions of said reservoir and wherein said compliant body section minimizes torque on said paddle as it rotates though said image forming material in said reservoir while allowing said edge to maintain contact with said surface of irregular geometry of said reservoir.

2. The component of claim 1 wherein said formed edge extends along said axially aligned projection.

3. The component of claim 1 wherein said polymeric material is polyester.

4. A device for containing image forming material comprising:

a enclosed reservoir including an irregular interior surface and a paddle comprising an axially elongated section radially extending in a single direction from an axis of rotation of said paddle capable of rotating in said reservoir and having an end face; and a component attached to said paddle for engaging said image forming material including a compliant polymeric body section having no openings therethrough attached to said end face and defined completely in a single first plane that is perpendicular to said axially elongated section having a front opposite said end face and a side wherein said body includes an axially aligned projection extending from said body section and not adjacent any other portion of said body and a formed edge reaching said irregular surface during rotation of said paddle for removing said image forming material from said surface not reached by said elongated section of said paddle, said formed edge defined completely in a single second plane directly adjoining said first plane, wherein said axially aligned projection and said formed edge are located along said side of the body section and said second plane defined by said formed edge is at an angle $\alpha$ between greater than 0 and less than 180 degrees from said front of said body, wherein said front of said body section is positioned nearest said reservoir surface, wherein said axially aligned projection extends to reach a corresponding interior surface in said reservoir, in both axial and radial directions of said reservoir and wherein said compliant body section minimizes torque on said paddle as it rotates though said image forming material in said reservoir while allowing said edge to maintain contact with said surface of irregular geometry of said reservoir.

5. The device of claim 4 wherein said formed edge extends along said axially aligned projection.

6. An image forming apparatus containing image forming material comprising:

a reservoir including an irregular interior surface and a paddle comprising an axially elongated section radially extending in a single direction from an axis of rotation of said paddle having an end face capable of rotating in said reservoir; and a component attached to said paddle for engaging said image forming material including a compliant polymeric body section having no openings therethrough attached to said end face and defined completely in a single first plane that is perpendicular to said axially elongated section having a front opposite said end face, and a side wherein said body includes an axially aligned projection extending from said body section and not adjacent any other portion of said body and a formed edge reaching said irregular surface during rotation of said paddle for removing said image forming material from said surface not reached by said elongated section of said paddle, said formed edge defined completely in a single second plane directly adjoining said first plane, wherein said axially aligned projection and said formed edge are located along said side of the body section and said second plane defined by said formed edge is angled at an angle $\alpha$ between greater than 0 and less than 180 degrees from said front of said body section, wherein said front of said body section is positioned nearest said reservoir surface, wherein said axially aligned projection extends to reach a corresponding interior surface in said reservoir, in both axial and radial directions of said reservoir and wherein said compliant body section minimizes torque on said paddle as it rotates though said image forming material in said reservoir while allowing said edge to maintain contact with said surface of irregular geometry of said reservoir.

7. The image forming apparatus of claim 6 wherein said formed edge extends along said axially aligned projection.

* * * * *